US007663327B2

(12) United States Patent
Bhatt et al.

(10) Patent No.: US 7,663,327 B2
(45) Date of Patent: Feb. 16, 2010

(54) NON-AXISYMMETRIC PERIODIC PERMANENT MAGNET FOCUSING SYSTEM

(75) Inventors: Ronak J. Bhatt, Cypress, TX (US); Chiping Chen, Needham, MA (US); Jing Zhou, Cambridge, MA (US); Alexey Radovinsky, Cambridge, MA (US)

(73) Assignee: Massachusetts Institute of Technology, Cambridge, MA (US)

( * ) Notice: Subject to any disclaimer, the term of this patent is extended or adjusted under 35 U.S.C. 154(b) by 738 days.

(21) Appl. No.: 11/434,835

(22) Filed: May 15, 2006

(65) Prior Publication Data

US 2006/0290452 A1 Dec. 28, 2006

Related U.S. Application Data

(60) Provisional application No. 60/680,694, filed on May 13, 2005.

(51) Int. Cl.
*H05H 7/00* (2006.01)

(52) U.S. Cl. ..... 315/501; 315/5.35; 315/39; 335/302; 335/306; 335/210; 250/396 R

(58) Field of Classification Search ..... 250/396 R, 250/398, 400, 427, 492.3; 335/209, 210, 335/302, 306; 315/3.5, 5.31, 5.34, 5.35, 315/39, 39.3, 500, 501
See application file for complete search history.

(56) References Cited

U.S. PATENT DOCUMENTS 3,398,314 A * 8/1968 Buck ..... 315/3.5
3,466,493 A * 9/1969 Phillips ..... 315/3.5
4,137,482 A 1/1979 Caryotakis
4,404,494 A 9/1983 Heynisch
4,545,056 A * 10/1985 Wortman et al. ..... 372/2
4,555,646 A 11/1985 Miram et al.
4,820,955 A * 4/1989 Boehme et al. ..... 315/3.5
4,912,366 A * 3/1990 Dionne ..... 315/3.5
4,942,336 A * 7/1990 Amboss et al. ..... 315/3.5
5,332,948 A * 7/1994 True et al. ..... 315/3.5
5,528,211 A 6/1996 Perreaut et al.
5,744,910 A 4/1998 Symons

OTHER PUBLICATIONS

Kory, "Effect of Geometric Azimuthal Asymmetries of PPM Stack of Electron Beam Characteristics" Transactions on Electron Devices, vol. 48, No. 1, Jan. 2001, pp. 38-44.

Basten et al., "Two-plane focusing of high-space-charge sheet electron beams using periodically cusped magnetic fields" Journal of Applied Physics, vol. 85, No. 9, 1999, pp. 6313-6322.

Chen et al., "Three-Dimensional Design of a Non-Axisymmetric Periodic Permanent Magnet Focusing System" Proceedings of the Knoxville, TN, USA May 16-20, 2005, XP010891345, pp. 1964-1966.

(Continued)

*Primary Examiner*—Haissa Philogene
(74) *Attorney, Agent, or Firm*—Gauthier & Connors LLP

(57) ABSTRACT

A permanent magnet focusing system includes an electron gun that provides an electron ribbon beam having an elliptical shape. A plurality of permanent magnets provide transport for the electron ribbon beam. The permanent magnets produce a non-axisymmetric periodic permanent magnet (PPM) focusing field to allow the electron ribbon beam to be transported in the permanent magnet focusing system.

21 Claims, 7 Drawing Sheets

OTHER PUBLICATIONS

Bhatt et al., "Theory and Simulation of nonrelativistic elliptic-beam formation with one-dimensional Child Langmuir flow Characteristics" Physical Review Special Topics-Accelerators and Beams 8, 014201, 2005, The American Physical Society, XP-002399890, pp. 014201-1 to 014201-5.

Hess et al., "Three-Dimensional Modeling of Intense Bunched Beams in RF Accelerators and Sources" Proceedings of the 2003 Particle Accelerator Conference, pp. 2634-2645.

* cited by examiner

| Parameter (unit) | Value |
|---|---|
| Current (A) | 0.11 |
| Voltage (kV) | 2.29 |
| $S$ (cm) | 1.912 |
| $k_{0y} / k_{0x}$ | 1.60 |
| $B_0$ (G) | 336.5 |
| $b/a$ | 6.0 |
| $b$ (cm) | 0.373 |
| $\theta_{max}$ | 10.4° |

FIG. 2

| Parameter (unit) | Value |
|---|---|
| $S$ (mm) | 19.12 |
| $a_0$ (mm) | 6.1 |
| $a_1$ (mm) | 18.2 |
| $b_0$ (mm) | 11.5 |
| $b_1$ (mm) | 22.0 |
| $Y_{c\,min}$ (mm) | 3.82 |
| $Y_{c\,max}$ (mm) | 6.52 |
| Thickness (mm) | 1.488 |
| $k_{0x}/k_{0y}$ (computed) | 1.598 |
| $B_0$ (G) (computed) | 336.3 |

FIG. 6

NON-AXISYMMETRIC PERIODIC PERMANENT MAGNET FOCUSING SYSTEM

PRIORITY INFORMATION

This application claims priority from provisional application Ser. No. 60/680,694 filed May 13, 2005, which is incorporated herein by reference in its entirety.

BACKGROUND OF THE INVENTION

The invention relates to the field of ribbon beam amplifier, and in particular to a three-dimensional (3D) design of a non-axisymmetric periodic permanent magnet (PPM) focusing field for a ribbon-beam amplifier (RBA).

High-intensity ribbon (thin sheet) beams are of great interest because of their applications in particle accelerators and vacuum electron devices. Recently, an equilibrium beam theory has been developed for an elliptic cross-section space-charge-dominated beam in a non-axisymmetric periodic magnetic focusing field.

In the equilibrium beam theory, a paraxial cold-fluid model is employed to derive generalized envelope equations which determine the equilibrium flow properties of ellipse-shaped beams with negligibly small emittance. The magnetic field is expanded to the lowest order in the direction transverse to beam propagation. A matched envelope solution is obtained numerically from the generalized envelope equations, and the results show that the beam edges in both transverse directions are well confined, and that the angle of the beam ellipse exhibits a periodic small-amplitude twist. Two-dimensional (2D) particle-in-cell (PIC) simulations with a Periodic Focused Beam 2D (PFB2D) code show good agreement with the predictions of equilibrium theory as well as beam stability.

SUMMARY OF THE INVENTION

According to one aspect of the invention, there is provided a permanent magnet focusing system. The permanent magnet focusing system includes an electron gun that provides an electron ribbon beam having an elliptical shape. A plurality of permanent magnets provides transport for the electron ribbon beam. The permanent magnets produce a non-axisymmetric periodic permanent magnet (PPM) focusing field to allow the electron ribbon beam to be transported in the permanent magnet focusing system.

According to another aspect of the invention, there is provided a ribbon beam amplifier. The ribbon beam amplifier includes an electron gun that provides an electron ribbon beam having an elliptical shape. A plurality of permanent magnets provides transport for the electron ribbon beam. The permanent magnets produce a non-axisymmetric periodic permanent magnet (PPM) focusing field to allow the electron ribbon beam to be transported in ribbon beam amplifier.

According to another aspect of the invention, there is provided a method of forming a permanent magnet focusing system. The method includes providing an electron gun that provides an electron ribbon beam having an elliptical shape. Also, the method includes forming a plurality of permanent magnets that provide transport for the electron ribbon beam. The permanent magnets produce a non-axisymmetric periodic permanent magnet (PPM) focusing field to allow the electron ribbon beam to be transported in the permanent magnet focusing system.

BRIEF DESCRIPTION OF THE DRAWINGS

FIG. 2 is a table demonstrating the system parameters for the inventive ribbon beam amplifier;

FIG. 6 is a table demonstrating the system parameters for a non-axisymmetric PPM design.

DETAILED DESCRIPTION OF THE INVENTION

The present invention comprises a three-dimensional (3D) design of a non-axisymmetric periodic permanent magnet (PPM) focusing field for a ribbon-beam amplifier (RBA).

Figure 1:
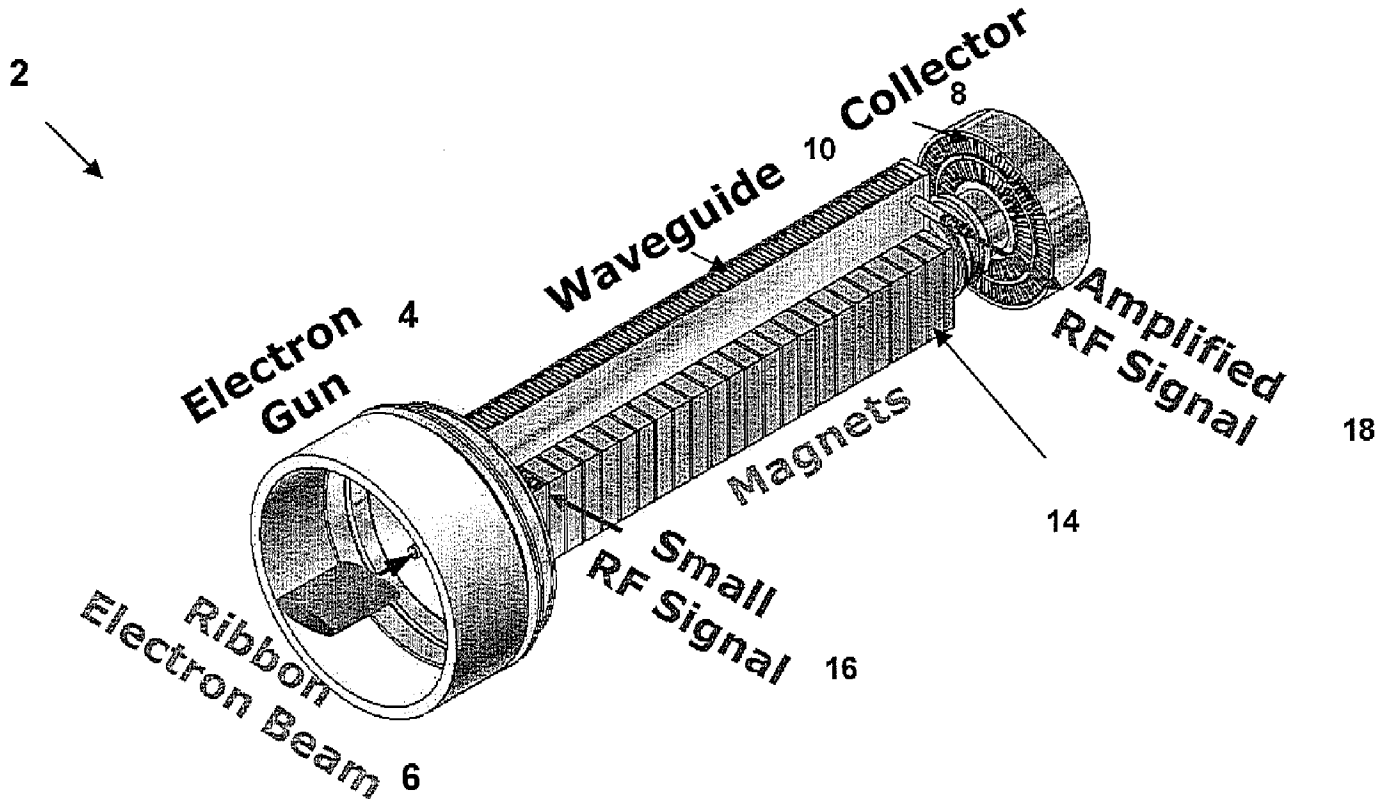
FIG. 1 shows a schematic diagram of a ribbon beam amplifier using the inventive non-axisymmetric periodic permanent magnet structure.

FIG. 1 shows a schematic diagram of a ribbon-beam amplifier using the inventive non-axisymmetric periodic permanent magnet structure 2. The structure 2 includes an electron gun 4 to form the necessary electronic charge to create a beam. The electron gun 4 provides to the structure 2 an electron ribbon beam 6. The ribbon beam amplifier receives a small RF signal 16 for amplification. The small RF signal 16 is coupled to a waveguide 10 to guide the small RF signal 16 while at the same time the electron ribbon beam 6, guided by various permanent magnets 14, couples with the RF signal 16 for amplification. In this embodiment, the electron ribbon beam 6 has an elliptical cross-sectional arrangement and so does the cross-section make-up of the permanent magnets 14, which will be discussed hereinafter.

After the ribbon beam 6 experiences coupling with the small RF signal 16 and is propagated through the waveguide, the RF signal experiences amplification and is outputted as an amplified RF signal 18. The amplification occurs in part by the electron ribbon beam 6 which is focused by the non-axisymmetric PPM focusing field produced by the permanent magnets 14. Note a collector 8 is positioned at the end of the structure 2 to collect the spent electron ribbon beam produced by the electron gun 4.

The 3D design of the non-axisymmetric PPM focusing field is performed with OPERA3D. In this design, the magnet material SmCo 2:17TC-16 is chosen for the magnets. It will be appreciated that the permanent magnets can include any stable temperature compensated magnets. Results from the 3D magnet design are imported into an OMNITRAK simulation of an electron ribbon beam, which shows good beam transport.

For beam transverse dimensions that are small relative to the characteristic scale of magnetic variations, for example, $(k_{0x}x)^2/6<<1$ and $(k_{0y}y)^2/6<<1$, a three-dimensional (3D) non-axisymmetric PPM focusing field can be described to the lowest order in the transverse dimension as $$B^{ext}(x) \cong B_0\left[\frac{k_{0x}^2}{k_0}\cos(k_0 s)x\hat{e}_x + \frac{k_{0y}^2}{k_0}\cos(k_0 s)y\hat{e}_y - \sin(k_0 s)\hat{e}_z\right], \quad (1)$$

where $k_0=2\pi/S$, $k_{0x}^2+k_{0y}^2=k_0^2$, and s is the axial periodicity length.

The 3D magnetic field in Eq. (1) is fully specified by the following three parameters: $B_0$, S and $k_{0y}/k_{0x}$. In order to achieve good beam transport, it is important to design the magnets which yield a three-dimensional magnetic field profile whose paraxial approximation assumes the form given by Eq. (1). In the design, the dimensions of the magnets are adjusted to achieve the three parameters specified by the equilibrium beam theory.

For the inventive ribbon-beam amplifier (RBA), the parameters for the ellipse-shaped electron beam and non-axisymmetric PPM focusing field are shown in FIG. 2. The ellipse-shaped electron beam has a current of 0.11 A, a voltage of 2.29 kV, a semi major axis (envelope) of 0.373 cm, an aspect ratio of 6.0, and a maximum twist angle of 10.4 degrees. Here, the aspect ratio is defined as the semi major axis relative to the semi minor axis of the ellipse.

In addition to assuring that parameters $B_0$, S and $k_{0x}/k_{0y}$ meet the design requirement, an important design consideration for the inventive RBA is that the non-axisymmetric PPM must be compatible with the corrugated slow-wave structure. This limits the range of magnet thickness one can work with.

Figure 3:
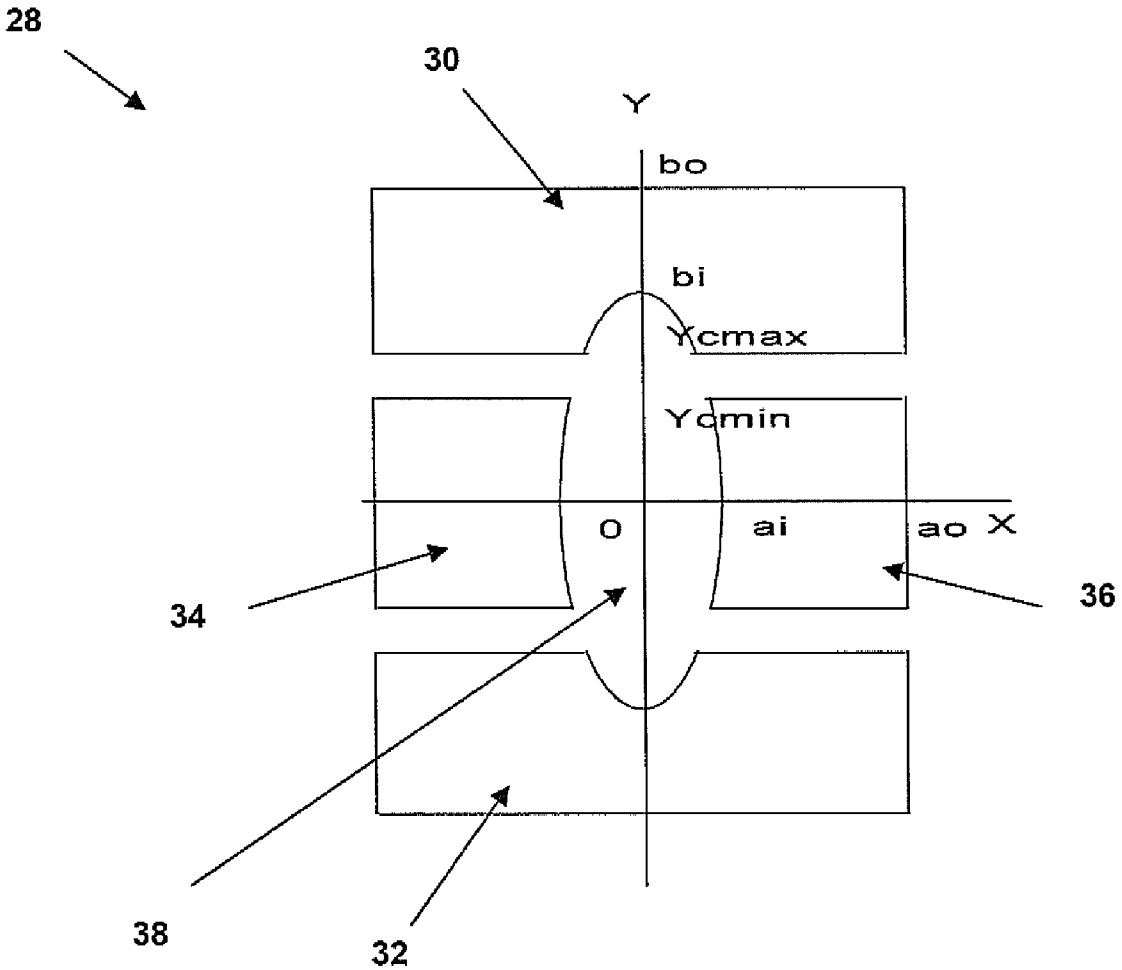
FIG. 3 is a schematic diagram illustrating a cross-sectional view of one of the permanent magnets that form a one-half period of non-axisymmetric PPM focusing field.

FIG. 3 shows a cross-sectional view of one of the permanent magnets that form a one-half period of non-axisymmetric PPM focusing field. The permanent magnet 28 has an open air elliptical cross-section 38. In this calculation, the major axis is in the y-direction. Each permanent magnet includes several components 30-36 on the major axis and minor axis that form its elliptical cross-section. The components 30-36 are each magnets that, when designed appropriately with the right dimensions, can provide in unison a non-axisymmetric PPM focusing field. The magnetic components 30 and 32 are arranged to provide a magnetic field component on the major axis, and the magnetic components 34 and 36 are arranged to provide a magnetic field component on the minor axis. The overall combination of the magnetic fields produced by the components 30, 32, 34, and 36 create a non-axisymmetric PPM focusing field in the open air elliptical cross-section 38 of the permanent magnet 28.

Figure 4:
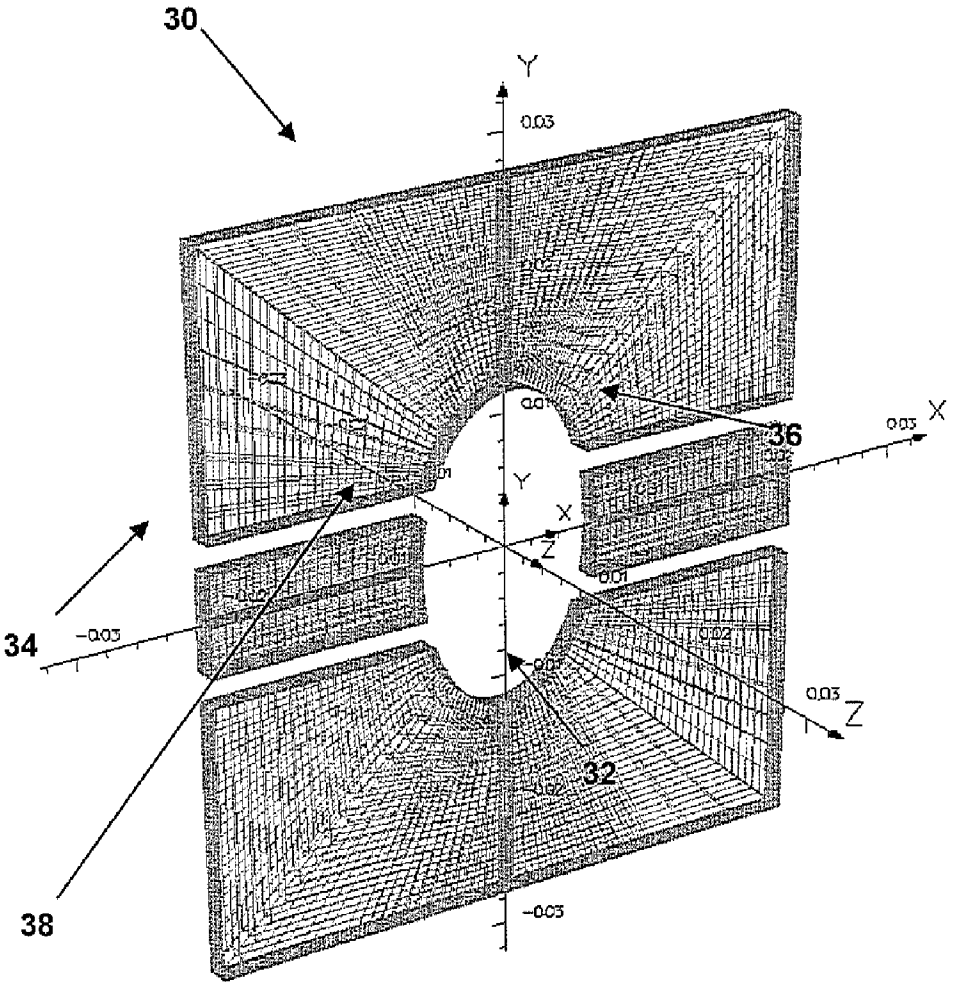
FIG. 4 is a schematic diagram corresponding to a 3D drawing of one of the permanent magnets shown in FIG. 3.

FIG. 4 shows the corresponding 3D drawing of one of the permanent magnets shown in FIG. 3. In FIG. 4, the magnetizations in the 4 permanent magnets are all along the z direction.

Figure 5:
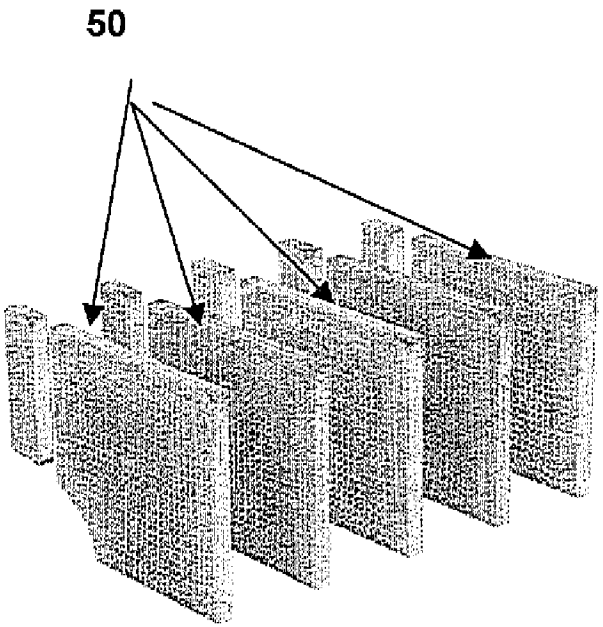
FIG. 5 is a schematic diagram illustration of a quadrant section of two and one-half periods of the non-axisymmetric periodic permanent magnet (PPM) focusing field.

FIG. 5 shows an example of a quadrant section of two and one-half periods of the non-axisymmetric PPM. The magnetization is in the z-direction, but changes its sign from one set of the magnets 50 to another, forming a periodic magnetic field as shown in Eq. (1). Because of the periodicity and symmetry, one only needs to compute the field distribution in a one-half period from z=−S/4 to S/4, and apply an anti-symmetric boundary condition in the calculations.

For the design parameters listed in FIG. 6, the maximum magnetic field on the z-axis calculated from the OPERA3D calculation is $B_0$=336.3 G, which is within 0.06% of the design goal. The parameter $k_{0x}/k_{0y}$ from the OPERA3D calculation is 1.598, which is within 0.13% of the design goal.

Figure 7A:
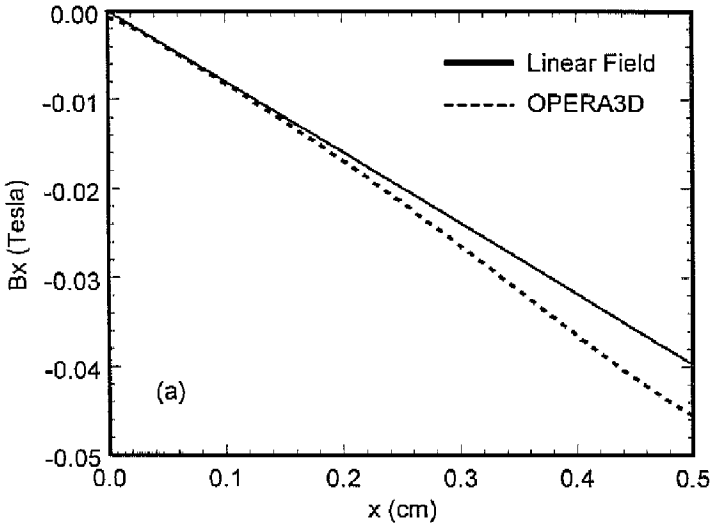
FIGS. 7A-7B are graphs illustrating the comparison of the transverse magnetic fields at z=S/4.
Figure 7B:
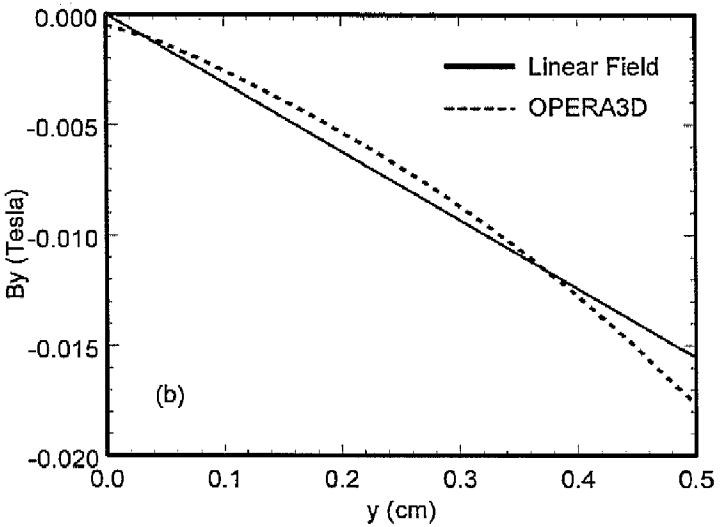

FIGS. 7A-7B shows the comparison of the transverse magnetic fields at z=S/4 from the OPERA3D calculation with those from the paraxial approximation in Eq. (1). FIG. 7A is a plot of the magnetic field in the x-direction and FIG. 7B is a plot of the magnetic field in the y-direction. The dashed curves are from the OPERA3D calculation, whereas the solid curves are from Eq. (1). Within the beam envelope with |x|<a=0.622 mm and |y|<b=3.73 mm, the magnetic fields from the OPERA3D calculation are well approximated by Eq. (1).

An inventive three-dimensional (3D) design is presented of a non-axisymmetric periodic permanent magnet focusing system which will be used to focus a large-aspect-ratio, ellipse-shaped, space-charge-dominated electron beam. In this design, the beam equilibrium theory is used to specify the magnetic profile for beam transport.

Although the present invention has been shown and described with respect to several preferred embodiments thereof, various changes, omissions and additions to the form and detail thereof, may be made therein, without departing from the spirit and scope of the invention.

What is claimed is:

1. A permanent magnet focusing system comprising:

an electron gun that provides an electron ribbon beam having an elliptical shape; and a plurality of permanent magnets that provide transport for said electron ribbon beam, said permanent magnets producing a non-axisymmetric periodic permanent magnet (PPM) focusing field to allow said electron ribbon beam to be transported in said permanent magnet focusing system.

2. The permanent magnet focusing system of claim 1 further comprising a waveguide that guides said electron ribbon beam through said permanent magnet focusing system.

3. The permanent magnet focusing system of claim 1, wherein each of said permanent magnets comprises an elliptical cross-section.

4. The permanent magnet focusing system of claim 1, wherein said electron ribbon beam comprises a current between 1 mA and 1 MA.

5. The permanent magnet focusing system of claim 4, wherein said electron ribbon beam comprises a semi major axis between 0.1 mm and 10 cm.

6. The permanent magnet focusing system of claim 4, wherein said electron ribbon beam comprises a voltage between 100 V and 10 MV.

7. The permanent magnet focusing system of claim 4, wherein said permanent magnets comprise stable temperature compensated magnets.

8. A ribbon beam amplifier comprising:

an electron gun that provides an electron ribbon beam having an elliptical shape; and a plurality of permanent magnets that provide transport for said electron ribbon beam, said permanent magnets producing a non-axisymmetric periodic permanent magnet (PPM) focusing field to allow said electron ribbon beam to be transported in said ribbon beam amplifier.

9. The ribbon beam amplifier of claim 8 further comprising a waveguide that guides said electron ribbon beam through said permanent magnet focusing system.

10. The ribbon beam amplifier of claim 8, wherein each of said permanent magnets comprises an elliptical cross-section.

11. The ribbon beam amplifier of claim 8, wherein said electron ribbon beam comprises a current between 1 mA and 1 MA.

12. The ribbon beam amplifier of claim 11, wherein said electron ribbon beam comprises a semi major axis between 0.1 mm and 10 cm.

13. The ribbon beam amplifier of claim 11, wherein said electron ribbon beam comprises a voltage between 100 V and 10 MV.

14. The ribbon beam amplifier of claim 8, wherein said permanent magnets comprise stable temperature compensated magnets.

15. A method of forming a ribbon beam amplifier comprising:

providing an electron gun that provides an electron ribbon beam having an elliptical shape; and forming a plurality of permanent magnets that provide transport for said electron ribbon beam, said permanent magnets producing a non-axisymmetric periodic permanent magnet (PPM) focusing field to allow said electron ribbon beam to be transported in said ribbon beam amplifier.

16. The method of claim 15 further comprising providing a waveguide that guides said electron ribbon beam through said permanent magnet focusing system.

17. The method of claim 15, wherein each of said permanent magnets comprises an elliptical cross-section.

18. The method of claim 15, wherein said electron ribbon beam comprises a current between 1 mA and 1 MA.

19. The method of claim 18, wherein said electron ribbon beam comprises a semi major axis between 0.1 mm and 10 cm.

20. The method of claim 18, wherein said electron ribbon beam comprises a voltage between 100 V and 10 MV.

21. The method of claim 15, wherein said permanent magnets comprise stable temperature compensated magnets.

* * * * *

UNITED STATES PATENT AND TRADEMARK OFFICE

CERTIFICATE OF CORRECTION

PATENT NO. : 7,663,327 B2
APPLICATION NO. : 11/434835
DATED : February 16, 2010
INVENTOR(S) : Bhatt et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 898 days.

Signed and Sealed this

Twenty-eighth Day of December, 2010

David J. Kappos

David J. Kappos
*Director of the United States Patent and Trademark Office*